United States Patent [19]

Calvert et al.

[11] 4,201,118

[45] May 6, 1980

[54] MACHINE FOR MANIPULATING A COLLAPSED BASKET STYLE CARTON INTO SET-UP CONDITION AND FOR ADHERING END FLAPS TO END PANELS AT EACH END OF THE CARTON

[75] Inventors: Rodney K. Calvert, Dunwoody; Alton J. Fishback, Austell, both of Ga.

[73] Assignee: The Mead Corporation, Dayton, Ohio

[21] Appl. No.: 963,202

[22] Filed: Nov. 24, 1978

[51] Int. Cl.[2] ..... B31B 1/76

[52] U.S. Cl. ..... 93/39 R; 93/53 SD; 271/132

[58] Field of Search ..... 93/39 R, 53 R, 53 M, 93/53 SD, 55, 41, 39.1 P; 271/131, 132

[56] References Cited

U.S. PATENT DOCUMENTS

| | | | |
|---|---|---|---|
| 3,015,256 | 1/1962 | Fahrenbach et al. | 271/132 X |
| 3,613,526 | 10/1971 | Jones | 93/53 R |
| 3,620,138 | 11/1971 | Neal et al. | 93/36.3 |
| 3,991,660 | 11/1976 | Calvert et al. | 93/53 SD |
| 4,109,444 | 8/1978 | Lee | 93/53 R X |

*Primary Examiner*—Robert D. Baldwin

*Attorney, Agent, or Firm*—Walter M. Rodgers; Walter A. Rodgers

[57] ABSTRACT

A reciprocable feeder arm (10) includes a projecting portion (12) for engaging an edge of a collapsed carton (C) in a hopper (1) and with the aid of a suction cup (13) removes the collapsed carton (C) from the hopper (1) and into a position adjacent but spaced from fixed suction cup means (3) into engagement with which one side wall (A1) of the carton is driven by movable suction cup means (4) which engages the opposite side wall (A) of the carton so that subsequent movement of the movable suction cup means (4) away from the fixed suction cup means (3) moves the carton side walls apart and tends to manipulate the carton into set-up condition during which movement a pair of spaced guides (6) engage end wall panels (B,D,B1,D1) at each end of the carrier and aid further in setting the carrier up while an arcuate fixed guide (6a) disposed adjacent the path of movement of the carton engages its bottom wall (E) so as to hold a pair of end flaps (F,G) foldably joined to the ends of the bottom wall are moved into approximately coplanar relation with the bottom wall so that a pair of fixed adhesive applicators (7) may apply adhesive to the inner surfaces of the end flaps (F,G) following which movement a reciprocable pusher element (8) engages the set-up carton (C4) along its upper edges and moves the carton between a pair of spaced plates (9) which engage the carton end flaps and force such flaps (F,G) into firm flat face contacting engagement with the end panels (B,D,B1,D1) at each end of the carton.

8 Claims, 11 Drawing Figures

Fig. 4
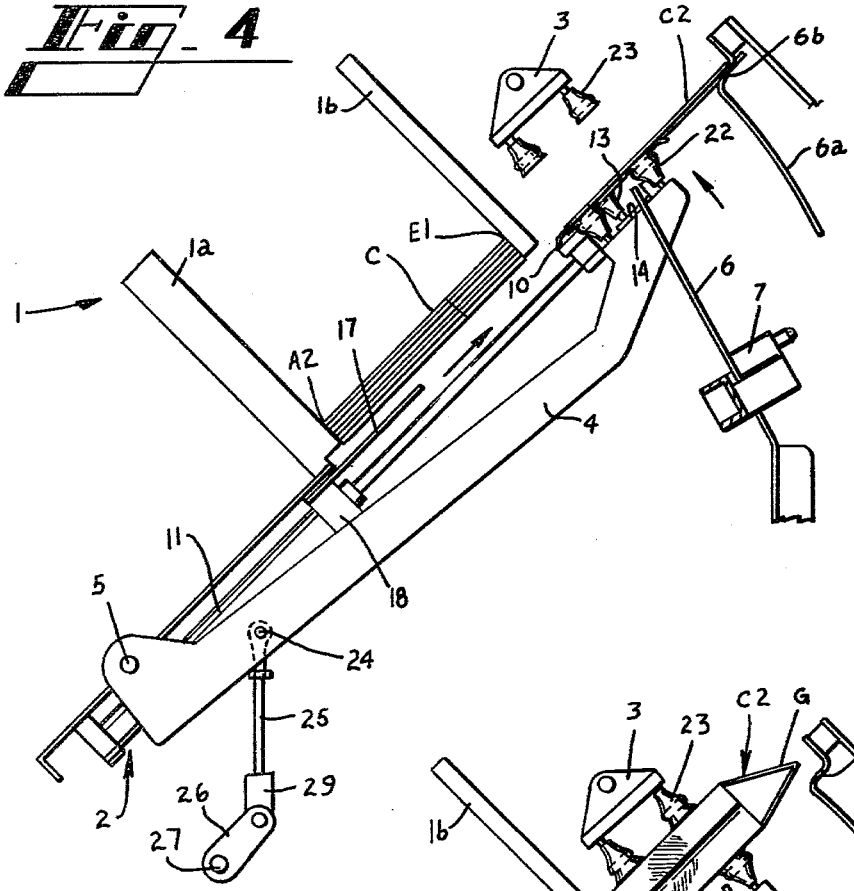
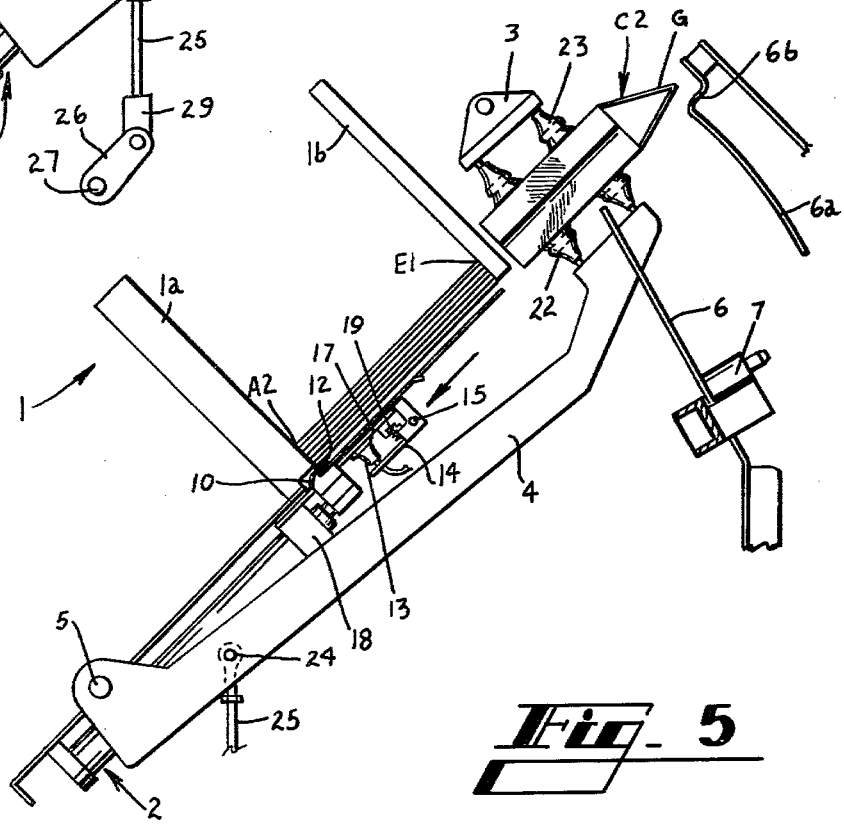
Fig. 5

Fig. 6
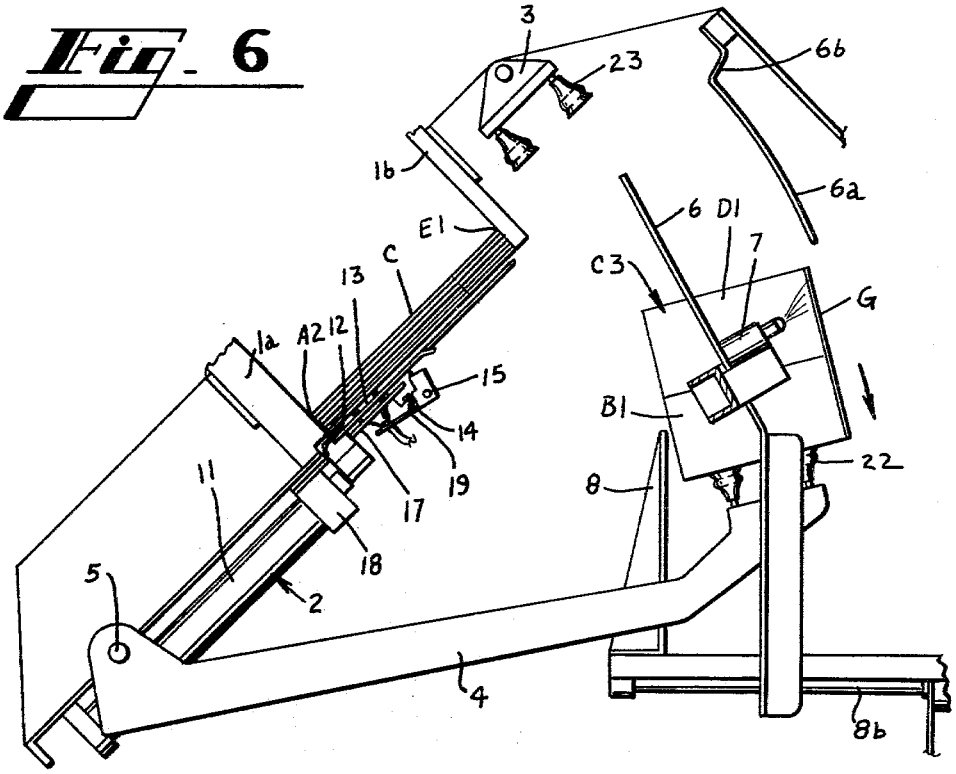
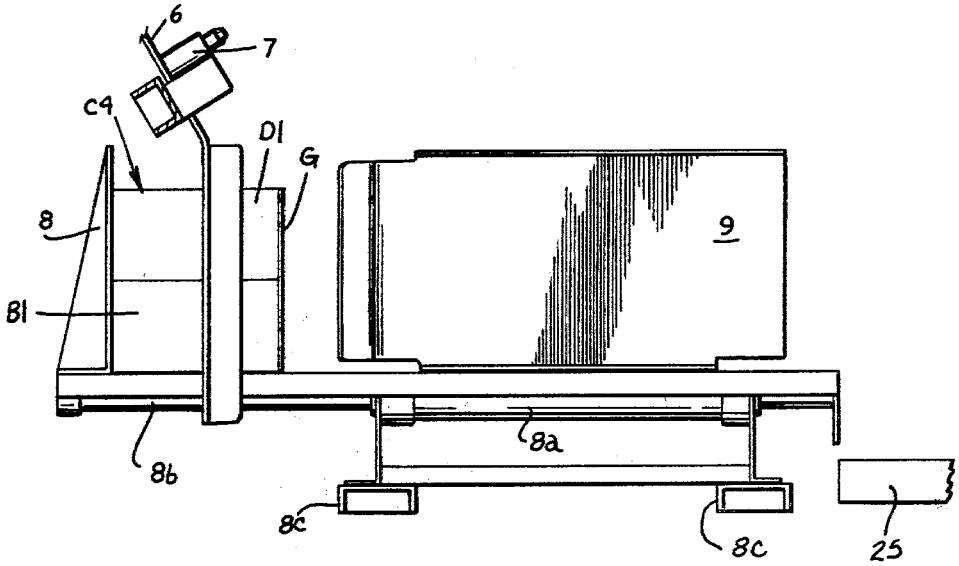
Fig. 7

MACHINE FOR MANIPULATING A COLLAPSED BASKET STYLE CARTON INTO SET-UP CONDITION AND FOR ADHERING END FLAPS TO END PANELS AT EACH END OF THE CARTON

TECHNICAL FIELD

This invention relates to a machine for setting up and completing certain manipulative operations of the panels of a collapsed basket style container the manufacture of which is but partially completed.

BACKGROUND ART

Known basket style article carriers are manufactured by the carton manufacturer and are in collapsed condition upon completion of the manufacturing operations. An example of such a carrier is disclosed in U.S. Pat. No. 2,537,452 owned by the assignee of this invention. Such known collapsible basket style carriers may be collapsed following depletion of the carrier contents.

Other known article carriers of the basket style include two rows of article receiving cells on each side of the carrier handle. An example of such known carrier is that disclosed in U.S. Pat. No. 3,784,053 owned by the assignee of this invention and in reality is simply an arrangement which is similar in many respects to that of U.S. Pat. No. 2,537,452 except for the fact that there are two rows of cells on each side of the handle.

DISCLOSURE OF INVENTION

According to this invention in one form, a carrier is provided which is partially manufactured into collapsed condition by a carton manufacturer and which is set up and completed at the plant of a bottler or other packager of products in primary packages. When completed by the packager, a carton formed according to this invention is not thereafter collapsible but is mechanically strong and well suited not only as a carry home and return carton but as a shipping container for primary packages such as bottles containing consumer products such as soft drinks, beer, specialty food items and the like. A collapsed carrier is withdrawn by reciprocable feeder means assisted by suction cup means from a hopper and deposited in the path of movement of a movable suction cup means which engages one side wall and drives the carton toward fixed suction cup means which in turn engages the opposite side wall. Thereafter swinging movement of the movable suction cup means in a direction away from the fixed suction cup means draws the side walls apart and initiates setting up of the carton. During this setting up movement the end wall panels of the carton are engaged by spaced apart fixed guides and the bottom wall of the carrier is engaged by a fixed arcuate guide, the guides being arranged to aid in completing a set up operation. Spaced apart adhesive applicators are arranged so as to apply adhesive to the inner surfaces of end flaps foldably joined to the end edges of the carton bottom wall and thereafter the carton is deposited in the path of reciprocable pusher means which drives the carton between a pair of spaced pressure plates which hold the carton end flaps in close face contacting relation with the carton end wall panels at each end of the carrier for a time sufficiently long to allow the adhesive to set. Thereafter the completed carrier is pushed from between the fixed spaced apart pressure plates and toppled onto a conveyor and is then in condition for loading with its top side up.

BRIEF DESCRIPTION OF THE DRAWINGS

In the drawings:

FIG. 4 is an enlarged side view of the hopper mechanism shown in FIG. 1 and shows the parts at the completion of a carton feeding operation;

FIG. 5 is a view similar to FIG. 4 but which shows the parts in the positions they occupy at the beginning of a carton feeding operation;

FIG. 6 is an enlarged side view of a portion of FIG. 1 which shows a set-up carton after its withdrawal from a hopper and during the application of adhesive to its end flaps;

FIG. 7 is an enlarged view of part of FIG. 1 which shows a carton after it is set up and after glue is applied but before the end flaps are folded into face contacting relation with the end wall panels of the carton;

FIG. 8 is an enlarged side view of a part of FIG. 1 and shows a series of cartons during the stage when the end flaps at each end of the carton are pressed into firm engagement with the end wall panels of the carrier; and in which

BEST MODE FOR CARRYING OUT THE INVENTION

Figure 1:
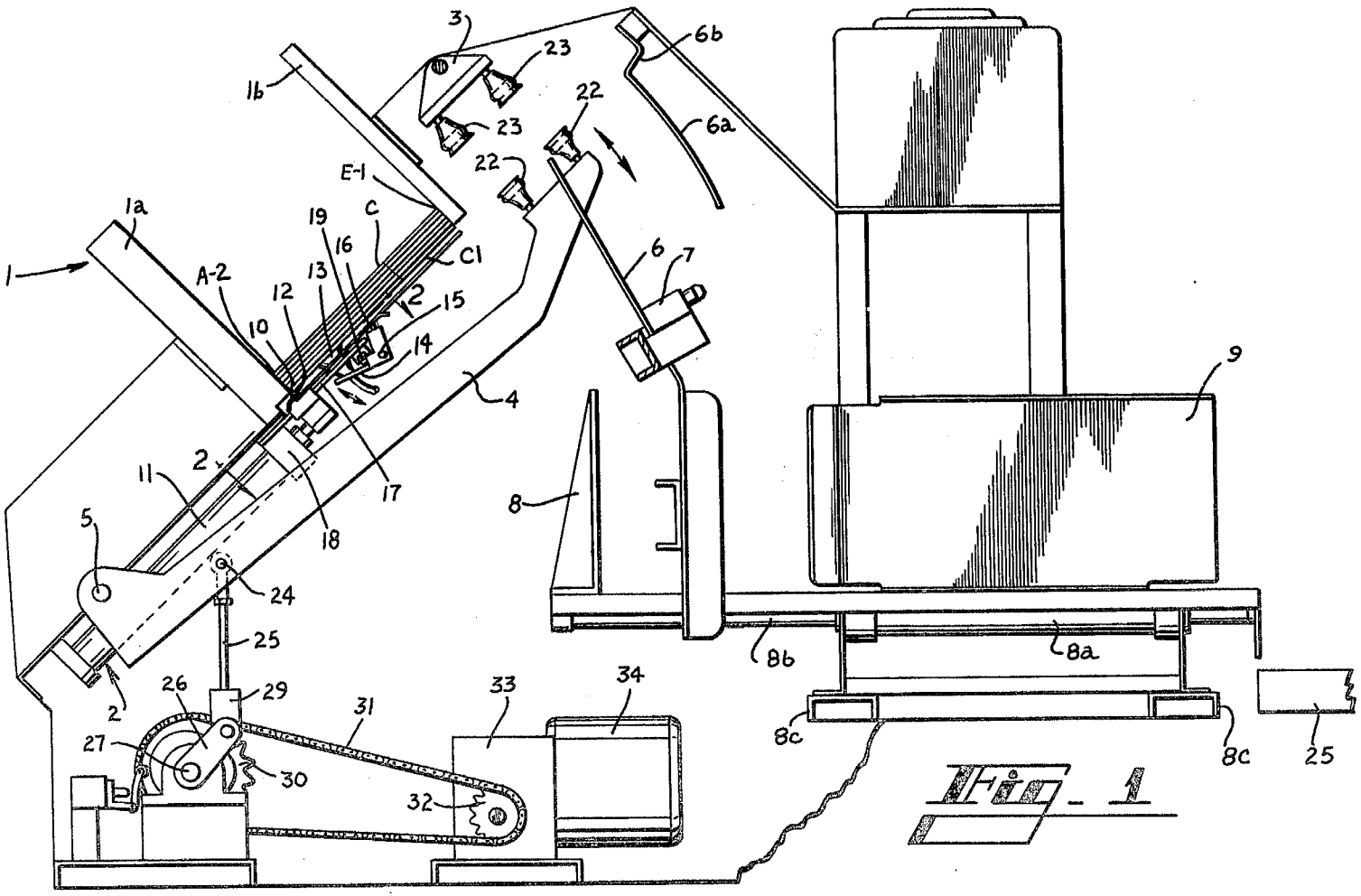
FIG. 1 is a schematic side view of a machine constructed according to this invention.

With reference to FIG. 1 the lowermost carton C1 in a stack of cartons C in a hopper generally designated by the numeral 1 is withdrawn by reciprocable feeder means generally designated by the numeral 2 and is moved into a position adjacent fixed suction cup means 3 at which position the carton is engaged by movable suction cup means 4 and is driven into cooperative engagement with the fixed suction cup means 3 so that the fixed suction cup means engages one carton side wall while the movable suction cup means 4 engages the opposite side wall. Thereafter clockwise swinging movement of movable suction cup means 4 about its fixed pivot 5 swings the carton downwardly between a pair of spaced guides designated by the numeral 6. These guides engage the carton end wall panels while an arcuate fixed guide 6*a* engages the carton bottom wall. During such movement adhesive is applied to end flaps foldably joined to the carton bottom wall and which are then substantially coplanar with the bottom wall by means of fixed adhesive applicators 7 which are located at opposite ends of the carton. Thereafter the carton is deposited in front of reciprocable pusher element 8 driven by piston cylinder device 8*a* and rod 8*b* which drives the carton between a pair of fixed side plates 9 which operation folds the carton end flaps inwardly and against the carton end wall panels at each end of the carton. Plates 9 and pusher 8 and associated parts are mounted on frame elements 8*c*. These spaced side plates 9 hold the end flaps in secure face contacting relation with the end wall panels for a time sufficiently long to allow the adhesive to set. Thereafter the carton is complete and is driven away from the space between the side plates 9 by a succeeding carton pushed from left to right as viewed in FIG. 1 by pusher 8.

Figure 1A:
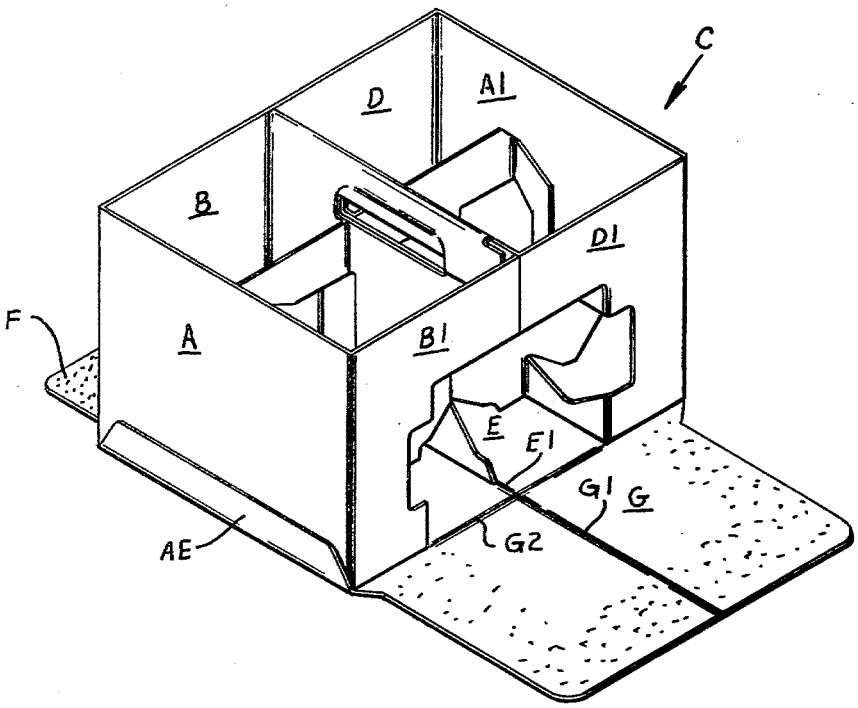
FIG. 1A is a perspective view of a partially set up carton of the type to which the invention is applicable.
Figure 1B:
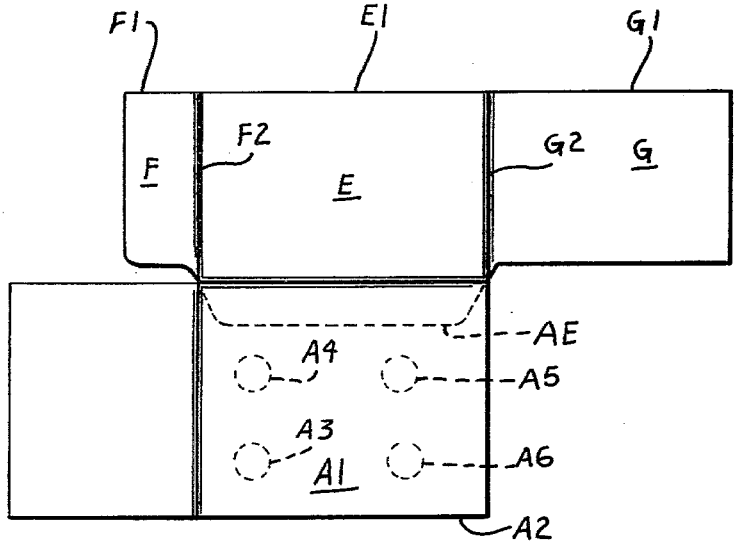
FIG. 1B is a view of a carton such as is shown in FIG. 1A in collapsed condition.

A carton of the type to which the machine of this invention is particularly applicable is shown in FIGS. 1A and 1B. A carton of this type is more fully disclosed and is claimed in U.S. Pat. Ser. No. 835,488 filed Sept. 22, 1977 and owned by the assignee of this invention.

As is best shown in FIG. 1A, the carton includes a first side wall A and a second side wall A1. A pair of end wall panels B and B1 are foldably joined to the end edges of panel A and also to the medial partition structure generally designated at P. End wall panel D is foldably joined to an end edge of side wall panel A1 and to an end of medial partition panel P while end wall panel D1 is similarly arranged so that one edge of end wall panel D1 is foldably joined to an end edge of side wall panel A1 and to an end of medial partition panel P. The bottom wall of the carrier is designated E and is provided with a medial fold line E1. An end flap F is foldably joined to one end of bottom wall E while an end flap G is foldably joined to an end edge of bottom wall E. A medial fold line G1 is formed in end flap G and is in alignment with the medial fold line E1. A medial fold line is also formed in end flap F and is designated in FIG. 1B at F1. As is apparent from FIG. 1A the bottom wall E is secured along its left hand edge to the bottom edge of side wall A by a glue flap AE which is secured in flat face contacting relation with side wall A and which is foldably joined to the left hand edge of bottom wall E.

In order to manipulate the set up carton from the position shown in FIG. 1A into collapsed condition represented by FIG. 1B, the side walls A and A1 are held in stationary condition while a force is applied to the right hand end of medial partition P and at the junction of end wall panels B1 and D1. This operation swings the end wall panels B, D, and B1 and D1 toward the left with respect to side walls A and A1 and bodily moves the partition panel P upwardly and toward the left as viewed in FIG. 1A. During this operation of course the side walls A and A1 come into close proximity to each other and meanwhile the end flap G collapses along its medial fold line G1 as does the end flap F. Following collapsing of the carrier as described, the structure is simply inverted and then appears as shown in FIG. 1B. It will be understood of course that the carrier of FIG. 1A represents the set-up form of the collapsed carrier shown in FIG. 1B which is the condition of the carton as it leaves the plant of the carton manufacturer.

Once the end flaps F and G are folded upwardly along the fold lines F2 and G2 and then secured in face contacting relation to the adjacent end wall panels, the carton cannot then be collapsed. When in the completed condition with the end flaps glued in place, the carton serves as a convenient carry home carrier and also serves as a sturdy and reliable shipping container.

As shown in FIG. 1, a stack of cartons is mounted in hopper 1 and is oriented in the hopper side wall A1 up and with the edge A2 shown as indicated in FIG. 1 adjacent the trailing part 1*a* of the hopper while the edge E1 of the collapsed carton as shown in FIG. 1B is disposed adjacent the leading side 1B of the hopper as shown in FIG. 1.

Figure 2:
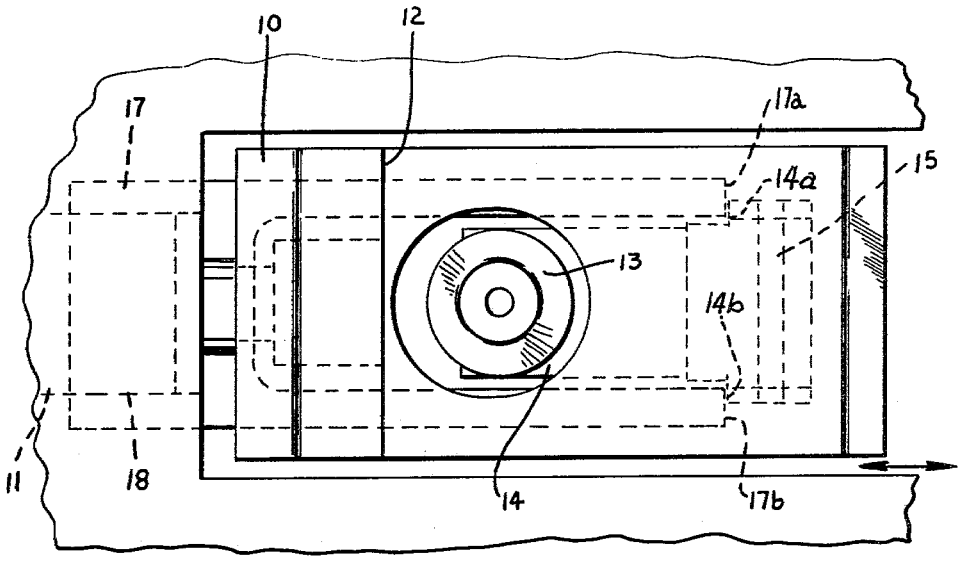
FIG. 2 is an enlarged detailed view taken along the line designated 2—2 in FIG. 1.
Figure 3:
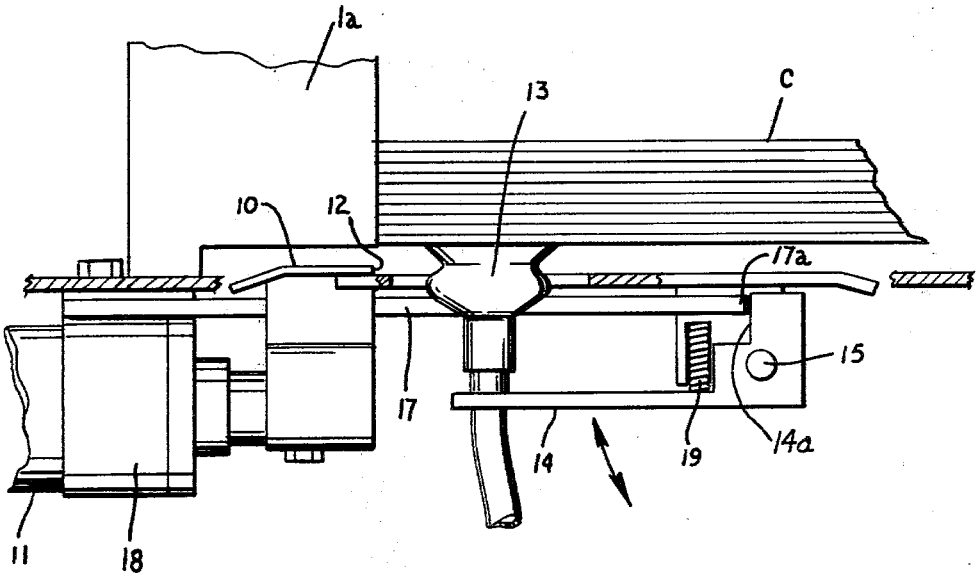
FIG. 3 is a view taken along the line designated 3—3 in FIG. 2.

For removing the lowermost carton such as that indicated at C1 from the hopper, a reciprocable feeder arm 10 is moved to and fro by any suitable means such as air piston and cylinder 11 and is provided with an upwardly projecting shoulder portion 12 which rides underneath the lower edge of side wall 1*a* of hopper 1 and engages the edge A2 of carton C1. Engagement with this shoulder projection 12 is facilitated and insured by a pair of laterally spaced suction cups (only one shown) designated by the numeral 13. Suction cups 13 are supported by arm 14 which is pivoted at 15 to downwardly projecting support plates 16 secured in any suitable manner to the reciprocable plunger 10 as best shown in FIG. 1. A fixed abutment means 17 is secured to a fixed mounting structure 18 and the arm 14 is biased in a counterclockwise direction about its pivot 15 by compression spring 19. Fixed abutment 17 is provided with end edges 17*a* and 17*b* as best shown in FIG. 2 which engage the upstanding projections 14*a* and 14*b* at such time as the reciprocable feeder arm 10 moves into its left hand position as shown in FIGS. 1, 2 and 3. This collision at 17*a* and 17*b* with parts 14*a* and 14*b* imparts clockwise swinging motion to arm 14 about its center of rotation 15 to cause the suction cup 13 to move into the up position shown in FIGS. 1 and 2 in which the suction cup engages the side wall A of the lowermost carton C1. Suitable control mechanism applies vacuum pressure to the suction cups 13 and thus causes these cups firmly to engage and grip the carton side wall A. Suitable control of suction pressure is effected automatically by known mechanism operating in synchronism with the other elements of the machine.

After the suction cups 13 engage the carton side wall A of carton C1, motion toward the right of reciprocable feeder arm 10 begins and carton C1 is drawn downwardly with its edge A2 in engagement with shoulder projection 12 by the action of spring 19. This action moves the carton from the position indicated in FIG. 1 at C1 into the position represented at C2 in FIG. 4 with an edge E1 of the carton resting on shoulder 6*b* of guide 6*a*.

Movable suction cup means 4 then swings in a counterclockwise direction about its center 5 and causes its suction cups 22 to engage the side wall A and to drive the carton at position C2 away from and out of engagement with the feeder arm 11 and suction cups 13 and into direct contact with the suction cups 23 of the fixed suction cup means 3 so that the carton side wall A1 is engaged and secured in position by the suction cups 23. Cups 22 and 23 engage side walls A and A1 at positions shown by dotted circles A3–A6 in FIG. 1B.

Thereafter the movable suction cup means 4 swings in a clockwise direction about its center 5 to draw the carton downwardly between the fixed spaced guides 6 and with the end wall panels B, B1, D, and D1 in engagement with the spaced guides 6 and with the bottom wall E in engagement with the arcuate guide 6*a*. Suction pressure in cups 23 is relieved at an appropriate instant following the beginning of downward movement of cups 22.

Movable suction cup means 4 oscillates back and forth about its center 5 due to its pivotal connection at 24 with operating rod 25 which in turn is reciprocated by crank arm 26 affixed to shaft 27 and pivotally connected at 28 to the lower base portion 29 of rod 25. Shaft 27 is driven by clutch 30 which in turn is operated by belt or chain 31 driven from sprocket 32 which forms a part of the gear box 33 affixed to and driven by motor 34.

Figure 8:
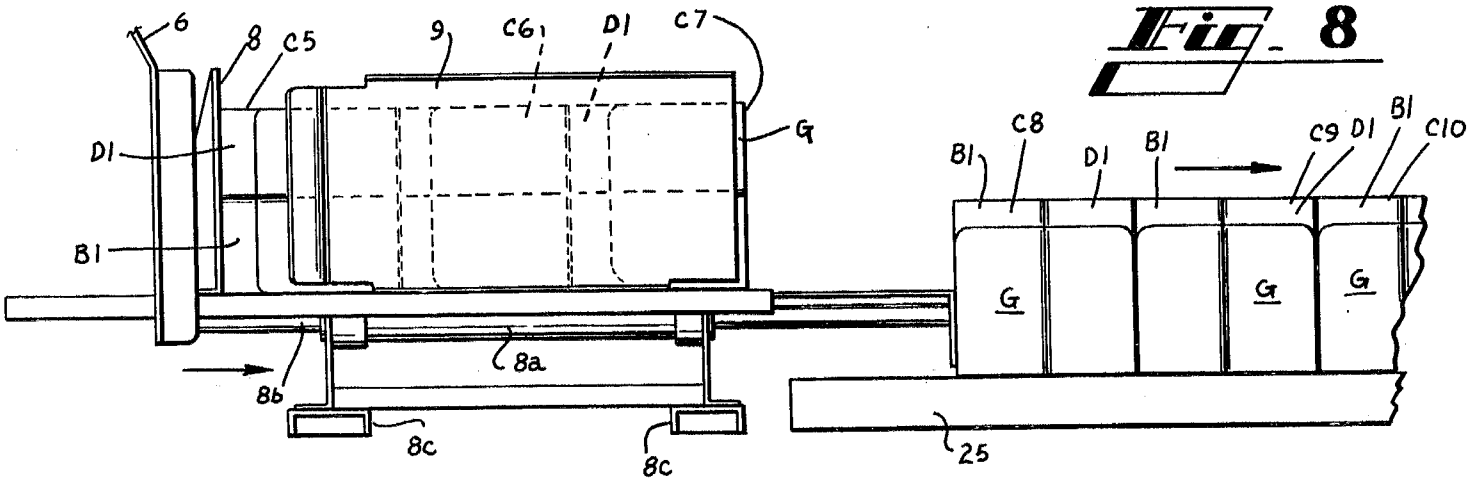
Figure 9:
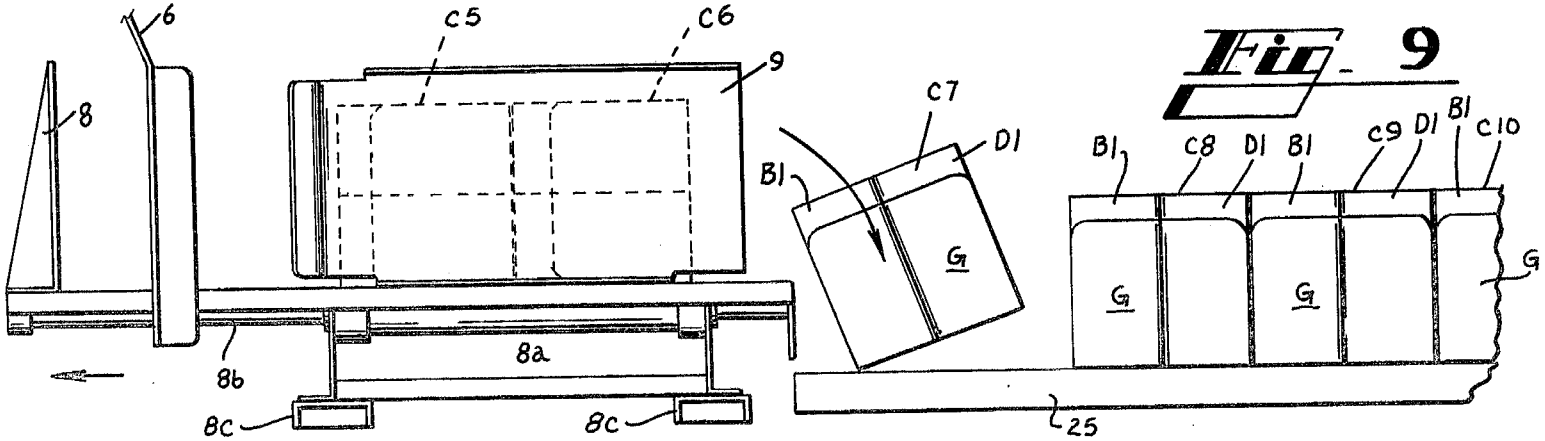
FIG. 9 is a view similar to FIG. 8 but which shows a carton being supplied from the machine of this invention onto an auxiliary conveyor and during which operation the carton is toppled into upright condition so that it then rests upon its bottom wall.

The carton side walls are spaced fully apart and the partition structure is disposed in its set-up condition during downward movement of the carton as is represented by FIGS. 1A and 6. Since the bottom panel E is fully set up with its two half sections in coplanar relationship, it follows that the end flaps F and G are fully set up with their two half sections arranged in coplanar relationship. Thus as the end flaps pass alongside the adhesive applicators 7, an application of adhesive such as glue is applied to the inner surfaces of the end flaps F and G. Further swinging movement of movable suction cup means 4 causes the carton to occupy the position represented at C4 in FIG. 7 at which point it is released by suction cups 22. Thereafter reciprocable pusher means 8 moves toward the right from the position represented in FIG. 7 and thus causes the end flaps at both ends of the carton to engage the fixed side plates 9. As this movement progresses, the end flaps are folded into face contacting relation with the end panels by the fixed side plates 9 which are spaced apart by a distance approximately equal to the length of the carrier. The side plates 9 are sufficiently long from left to right to allow the adhesive to set up. As a particular carton such as that represented at position C8 in FIG. 8 is fully completed, it is pushed out from between the side plates 9 by a succeeding carton as will be obvious from FIGS. 8 and 9. A completed carton such as C9, C10, C11, and C12 may then move away on an auxiliary conveyor designated by the numeral 35.

INDUSTRIAL APPLICABILITY

It is apparent from the above description that a machine constructed according to this invention is particularly well suited for withdrawing from a hopper and for setting up and glueing a collapsed basket style carton of the type which is intended for heavy duty usage and which need not be collapsed after it is set up initially. It is also apparent that the machine of this invention is intended primarily for use by a packager such as a soft drink bottler or the like as distinguished from usage by a carton manufacturer. It is also apparent that a machine constructed according to this invention is inherently rugged and durable and not susceptible to any appreciable degree to breakdowns and to faulty operations due to wear and lost motion of the parts.

The embodiments of the invention in which an exclusive property or privilege is claimed are defined as follows:

We claim:

1. A machine for withdrawing the lowermost carton (C) from a stack of cartons in a hopper (1) said machine comprising a reciprocable feeder arm (10) disposed below the hopper (1) and having an upwardly projecting part (12) for engaging an edge (A2) of said carton and for sliding such carton from the hopper, suction cup means (13) pivotally mounted on said feeder arm, biasing means (19) for imparting swinging movement to said suction cup means (13) downwardly and away from said hopper (1), and fixed abutment means (17) disposed for engagement by a part of said suction cup means (13) for swinging said suction cup means into engagement with said carton at approximately the beginning of a feeding stroke of said feeder arm and in opposition to said biasing means.

2. A machine according to claim 1 wherein said fixed abutment means (17) is engaged by a part of said suction cup means (13) at approximately the end of a return stroke of said feeder arm.

3. A machine according to claim 1 wherein said biasing means (19) comprises compression spring means and effects downward swinging movement of said suction cup means (13) relative to said feeder arm (10) during the initial stages of a feeding stroke of said feeder arm (10).

4. A machine according to claim 1 wherein said suction cup means (13) is mounted on an arm (14) pivotally mounted to support plate means (15) secured to feeder arm (10) and wherein said suction cup means (13) aids in holding said edge (A2) of said carton in engagement with said upwardly projecting part (12) of said feeder arm (10) during a feeding stroke.

5. A machine for setting up a collapsed carton having a pair of parallel juxtaposed side walls (A,A1) and a medially collapsible bottom wall (E) foldably joined along its side edges to the bottom edges of said side walls (A,A1) respectively, said machine comprising feeder means (2) for removing a collapsed carton (C) from a hopper (1), stationary suction cup means (3) disposed above the collapsed carton (C2) after its removal from the hopper, movable suction cup means (4) disposed for movement below the carton (C2) and engageable with one side wall (A) of the carton for moving the other side wall (A1) thereof out of cooperative engagement with said feeder means and into engagement with said stationary suction cup means (3), said movable suction cup means (4) thereafter being movable away from said stationary suction cup means (3) to move the carton side walls apart, a fixed bottom wall engaging guide (6*a*) arranged to engage and hold said bottom wall (E) in set-up condition, said bottom wall engaging guide (6*a*) being arcuate in configuration and said movable suction cup means (4) being mounted for swinging movement about a fixed center (5) so that the path of movement of the swing end of said movable suction cup means inscribes a path which tracks said arcuate bottom wall engaging guide (6*a*).

6. A machine for setting up a collapsed carton having a pair of parallel juxtaposed side walls (A,A1) end wall panels (B, D, B1, D1) foldably joined respectively to the ends of said side walls and to medial partition structure and being in parallel close juxtaposition to each other when the carton is collapsed, a medially collapsible bottom wall (E) foldably joined along its side edges to the bottom edges of said side walls (A, A1) respectively, and medially collapsible end flaps (F, G) foldably joined respectively to the end edges of said bottom wall, said machine comprising means for withdrawing collapsed cartons from a hopper (1), means (4, 22, 23) for moving the carton side walls apart so as to move the side walls, the end wall panels and the medial partition structure into set-up condition, a pair of spaced guides (6) for engaging the end wall panels to hold the carton side walls and end wall panels in set-up condition, adhesive applicators (7) disposed adjacent said spaced guides (6) respectively and arranged to apply adhesive to said end flaps (F, G) reciprocable pusher means (8) disposed below said hopper (1) and arranged to receive a carton following the application of adhesive to said end flaps and to move the carton horizontally, and a pair of spaced plates (9) disposed to receive a carton therebetween from said pusher means (8).

7. A machine according to claim 6 wherein said spaced plates (9) are spaced apart by a distance approximately equal to the length of the carton and are arranged to engage said end flaps (F, G) and to hold them in flat face contacting relation with the associated end wall panels (B, D, B1, D1) and to aid in effecting adhesive bonds therebetween.

8. A machine for setting up a collapsed carton having a pair of side walls (A, A1) to the bottom edges of which a medially collapsed bottom wall (E) is foldably joined along its side edges and to the ends of each of which end wall panels (B, D, B1, D1) are foldably joined, the end wall panels (B, D, B1, D1) being foldably joined along their medial edges to medial partition structure and medially collapsed end flaps being foldably joined to the end edges of said bottom wall (E), said machine comprising a hopper (1) in which a supply of collapsed cartons (C) is stored, a reciprocable feeder arm (10) disposed under said hopper (1) and having a shoulder (12) for engaging an edge (A2) of the lowermost carton in said hopper and for sliding such carton out of the hopper, stationary suction cup means (3) mounted on a fixed support and disposed above the path of travel of said feeder arm (10) and at the outer extremity of travel thereof, movable suction cup means (4) disposed below the path of travel of said feeder arm and arranged to engage one side wall (A) of a collapsed carton from below and operable to move the other side wall (A1) of the carton into engagement with said stationary suction cup means (3) and thereafter movable in a generally downward direction to move the carton side walls (A, A1) apart whereby the bottom wall and associated end flaps are set up, a bottom wall engaging guide (6a) arranged to engage the carton bottom wall (E) during downward movement of the carton for holding said bottom wall (E) in set-up condition, a pair of spaced guides (6) arranged to engage said end wall panels (B, D, B1, D1) for holding said end wall panels in set-up condition during downward movement of the carton, adhesive applicators (7) mounted adjacent said spaced guides respectively for applying adhesive to the interior surfaces of said end flaps (F, G) at both ends of the carton, spaced side plates (9) arranged to receive a carton (C) therebetween with said end flaps (F, G) in flat face contacting relation with said side plates (9) for applying bonding pressure thereto to secure said end flaps to said end wall panels at both ends of the carton, and reciprocable pusher means (8) for sequentially engaging cartons supplied by said movable suction cup means (4) and for moving the cartons between said spaced plates (9) in such manner that preceding cartons are moved by succeeding cartons.

* * * * *